1/3/84 OR 4,423,780

United States Patent [19]

Vigneri et al.

[11] 4,423,780

[45] Jan. 3, 1984

[54] METHOD AND APPARATUS FOR FRACTURING HYDROCARBON-BEARING WELL FORMATIONS

[76] Inventors: Ronald J. Vigneri, 9 Leone Terr., Kinnelon, N.J. 07405; Christopher J. Nickos, 839 Laurel Blvd., Lanoka Harbor, N.J. 08734

[21] Appl. No.: 265,336

[22] Filed: May 19, 1981

[51] Int. Cl.[3] ..... E21B 43/26

[52] U.S. Cl. ..... 166/308; 166/63; 166/90

[58] Field of Search ..... 166/307, 308, 271, 63, 166/90

[56] References Cited

U.S. PATENT DOCUMENTS

| | | | |
|---|---|---|---|
| 3,096,819 | 7/1963 | White, Jr. | 166/309 |
| 3,195,634 | 7/1965 | Hill | 166/308 |
| 3,303,880 | 2/1967 | Scott | 166/308 |
| 3,664,422 | 5/1972 | Bullen | 166/308 |
| 3,759,329 | 9/1973 | Ross | 166/308 |
| 3,804,175 | 4/1974 | Miller | 166/90 |
| 3,842,910 | 10/1974 | Zirgg | 166/308 |
| 3,896,879 | 7/1975 | Sareen | 166/308 |

*Primary Examiner*—William F. Pate, III

[57] ABSTRACT

Method and apparatus in which a hydrocarbon-bearing well formation penetrated by a borehole is fractured with apparatus located outside the well by injecting gases into the well to elevate the pressure and temperature within the well formation and to maintain the elevated pressure and temperature until the formation is fractured, the apparatus including a gas generator of the type in which a fuel, such as hydrogen peroxide, is decomposed by a catalyst to form high temperature decomposition gases, such as steam and oxygen, and an air compressor for injecting compressed air into the well to aid in raising the pressure within the well formation so as to pack the decomposition gases into the formation and to maintain the raised pressure until the formation is fractured.

23 Claims, 2 Drawing Figures

METHOD AND APPARATUS FOR FRACTURING HYDROCARBON-BEARING WELL FORMATIONS

Figure 1:
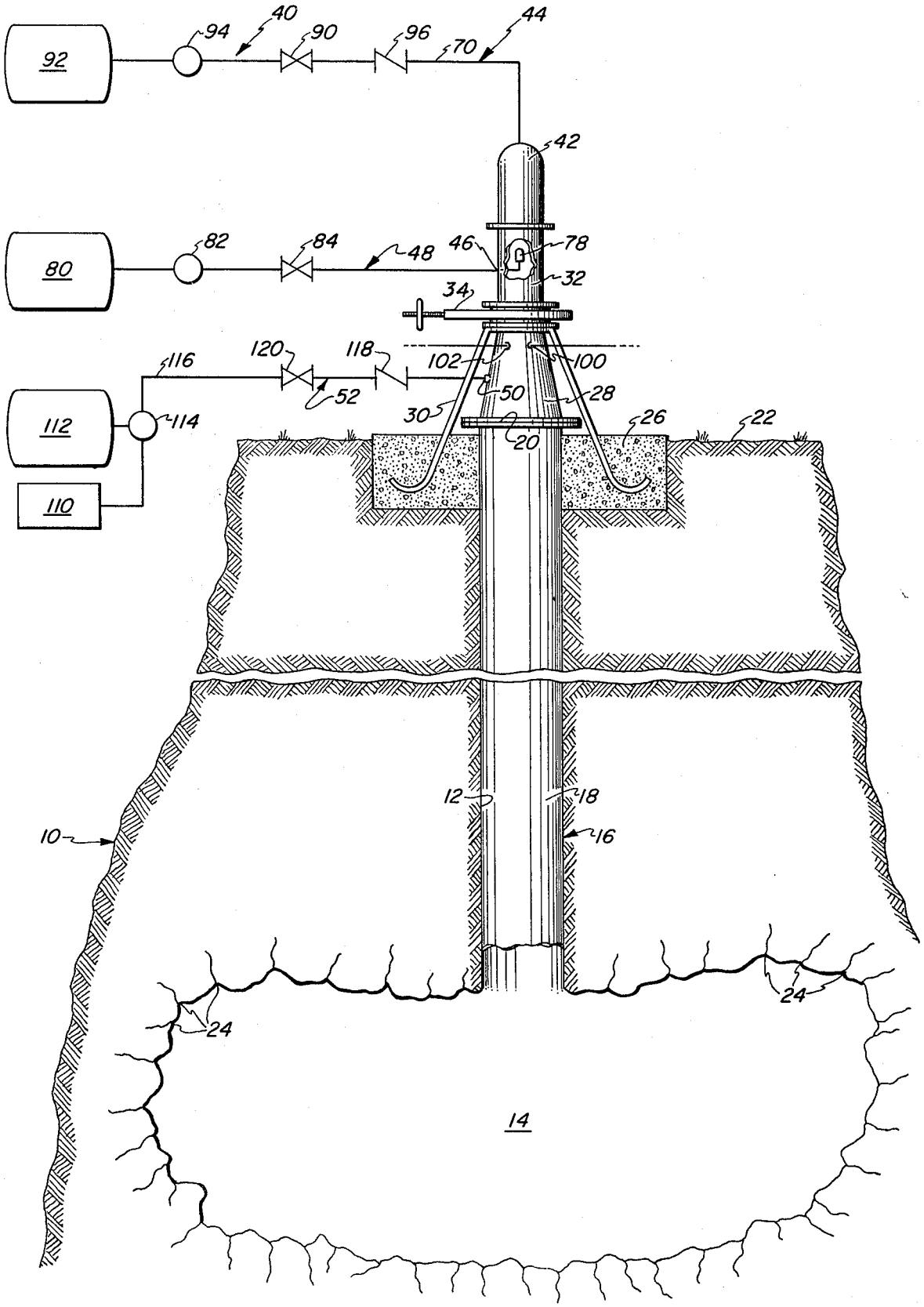

The present invention relates generally to increasing the yield of existing underground hydrocarbon-bearing well formations and pertains, more specifically, to method and apparatus for fracturing such formations to effect the increase in yield.

It has been known for some time that the yield of hydrocarbons, such as gas and petroleum, from wells can be increased by fracturing the formation so as to stimulate the flow of hydrocarbons in the well. Various formation fracturing procedures have been proposed and many now are in use. Among these procedures are treatments with various chemicals (usually acids in aqueous solutions), hydraulic fracturing in which liquids are injected under high pressure (usually with propping agents), explosive methods in which explosives are detonated within the formations to effect mechanical fracture, and combinations of the above procedures.

Chemical treatments usually involve the use of large volumes of chemicals which can be expensive and difficult to handle, and which pose problems of contamination and disposal. Hydraulic fracturing ordinarily requires that large volumes of liquids be made available at the well site and that equipment be made available for handling these large volumes of liquid. Again, there can be disposal problems, as well as contamination of the well. Explosive methods can be exceptionally hazardous from the standpoint of transporting and using the necessary explosives and present difficulties in controlling the effects of such a procedure.

Other suggestions for increasing the yield of existing wells entail heating the formation to induce the flow of hydrocarbons from the formation. Methods and apparatus have been developed by which various combustion devices have been lowered into the borehole of a well to attain heating of the formation adjacent the device. The effectiveness of such devices is limited by the necessity for fitting the devices into a borehole and then obtaining only more-or-less localized effects.

It is an object of the present invention to enable an existing well formation to be fractured effectively with aboveground equipment which easily is transported to a site, readily installed and requires a minimum supply of materials to accomplish effective fracturing.

Another object of the invention is to provide method and apparatus for increasing the yield of an existing hydrocarbon-bearing well formation with little or no risk of contaminating the formation or the environment in the vicinity of the well formation and without presenting a disposal problem at the site of the formation.

Another object of the invention is to provide method and apparatus of the type described and which will accomplish fracturing throughout greater areas of a formation rather than generating merely localized effects.

Still another object of the invention is to provide method and apparatus of the type described and which will demonstrate a dramatic increase in the yield of hydrocarbons from a formation within a relatively short span of time.

Yet another object of the invention is to provide method and apparatus of the type described and in which costs are sharply reduced by virtue of the requirement for less equipment and more simplified equipment and procedures which require less manpower and can be accomplished safely, economically and effectively without highly skilled specialists.

A further object of the invention is to provide method and apparatus in which known technology from the totally unrelated field of reaction motors finds a unique application in effecting a novel approach to the problem of fracturing hydrocarbon-bearing well formations.

A still further object of the invention is to provide method and apparatus of the type described and which enables repeated fracturing of the same formation for continuing a higher yield from a well.

Yet a further object of the invention is to provide method and apparatus of the type described and which can be utilized to increase the yield from formations which heretofore have not responded to other available procedures or which even may have suffered contamination or damage as a result of attempts at using other procedures.

The above objects, as well as still further objects and advantages are attained in the present invention which may be described briefly as the method for increasing the yield of hydrocarbons from an underground hydrocarbon-bearing well formation by fracturing the formation, the formation being penetrated by a borehole having an opening at ground level, the method comprising the steps of: placing and connecting a gas generator in position outside the well for supplying heated gas under pressure to the opening of the borehole; essentially sealing the connection between the gas generator and the borehole opening so as to enable the establishment of elevated pressures within the well; operating the gas generator to inject gas into the well at a relatively high temperature, the high temperature being less than the thermal ignition temperature of the hydrocarbons in the formation; increasing the pressure within the well to an elevated relatively high pressure; and maintaining an elevated pressure in the well at least until the formation is fractured. The invention further includes apparatus for increasing the yield of hydrocarbons from an underground hydrocarbon-bearing well formation by fracturing the formation, the formation being penetrated by a borehole having an opening at ground level, the apparatus comprising: a gas generator for operation to inject gas under pressure into the well at a relatively high temperature, the high temperature being less than the thermal ignition temperature of the hydrocarbons in the formation; means for placing and connecting the gas generator in position outside the well for supplying the high temperature gas under pressure to the opening of the borehole; and means for essentially sealing the connection between the gas generator and the borehole opening so as to enable the establishment and maintenance of elevated pressures within the well at least until the formation is fractured.

Figure 2:
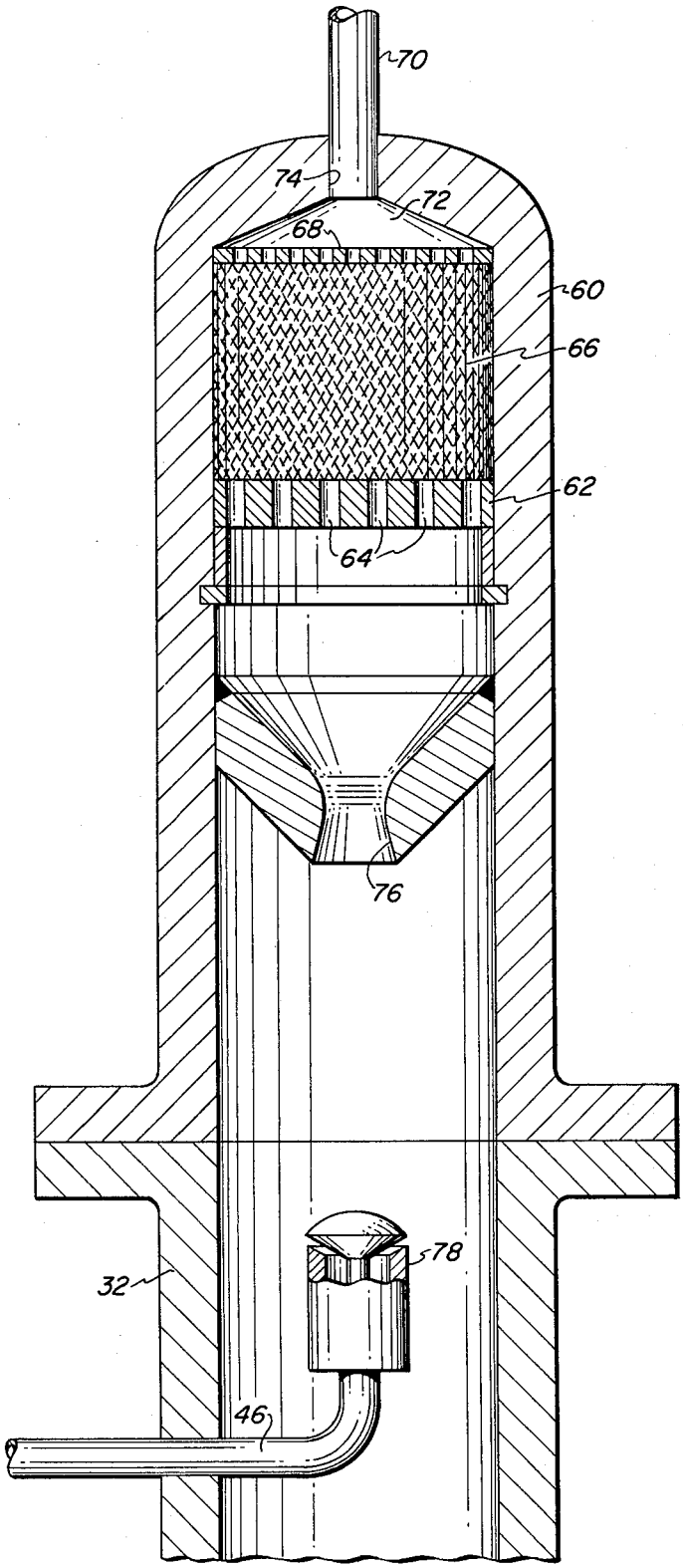

The invention will be understood more fully, while still further objects and advantages will become apparent, in the following detailed description of an embodiment of the invention illustrated in the accompanying drawing, in which:

FIG. 1 is a partially schematic diagram of an installation constructed and operated in accordance with the present invention; and FIG. 2 is an enlarged vertical cross-sectional view of a portion of the apparatus of FIG. 1.

Referring now to the drawing, and especially to FIG. 1 thereof, an underground hydrocarbon-bearing well formation is illustrated schematically at 10 and is seen to be penetrated by a borehole 12 which extends into a cavity 14 to establish a well 16 from which hydrocarbons, such as petroleum or gas, can be drawn. A well casing 18 has an opening 20 at the upper end of the casing, essentially at ground level 22, the lower end of the well casing 18 extending into the cavity 14 within the formation 10. The borehole 12 and well casing 18 are parts of an existing open well structure, having been constructed in accordance with known principles of petroleum and gas well construction.

In order to increase the yield of hydrocarbons from well 16, formation 10 is to be fractured utilizing the method and apparatus of the present invention. That is, fissures 24 in the formation 10 through which the hydrocarbons flow into the well 16 either will be unclogged or will be enlarged, or new fissures will be formed by fracturing of the formation 10 in the vicinity of the well 16. Fracturing is accomplished by sealing the well 16 and then injecting gases at relatively high temperature and elevated pressures and maintaining a high temperature and elevated pressure within the well until the formation is fractured.

Well 16 is prepared by installing a concrete anchor 26 adjacent the opening 20 of well casing 18, and borehole 12. An adaptor sleeve 28 is affixed to the opening 20 and is secured in place by a mounting bracket 30 which is embedded in anchor 26. A tubular manifold 32 is located above the adaptor sleeve 28 and a sealing valve 34 is placed between the manifold 32 and adaptor sleeve 28. When valve 34 is closed, the well 16 essentially is sealed. In some well constructions where the well casing is bottom sealed or otherwise anchored within the ground, a separate concrete anchor, such as anchor 26, and a mounting bracket, such as bracket 30, are not required.

The system for elevating the pressure in the well 16 and for injecting gases at relatively high temperatures is shown schematically at 40. System 40 includes a gas generator 42 secured to the manifold 32 and having a fuel supply system 44 for generating gases, in a manner which will be described in greater detail hereinafter, a cooling water inlet 46 having a cooling water supply system 48, and a compressed gas inlet 50 having a compressed gas supply system in the form of compressed air supply system 52.

Basically, the method of the present invention entails placing and connecting a gas generator, such as gas generator 42, in position outside the borehole 12 of well 16 for supplying heated gas under pressure to the opening 20 of the borehole, essentially sealing the connection between the gas generator and the borehole opening, as accomplished by adaptor sleeve 28 and manifold 32, so as to enable the establishment of elevated pressures within the borehole 12, and well 16, operating the gas generator to inject gas into the borehole at a relatively high temperature, the high temperature being somewhat less than the thermal ignition temperature of the hydrocarbons in the formation 10, increasing the pressure within the borehole to an elevated relatively high pressure, and maintaining an elevated pressure in the borehole at least until the formation is fractured. In a typical installation where the thermal ignition temperature of the hydrocarbons in the well 16 is about 1050° F., the relatively high temperature of the gas injected into the borehole by the gas generator would be about 800° F. to 1000° F. The elevated relatively high pressure typically would be at least 500 psia to 1500 psia and, depending upon the structure of formation 10, can go higher, the maximum pressure being limited only by the pressure capabilities of the equipment used to establish the high pressure.

Turning now to FIG. 2, as well as to FIG. 1, the specific gas generator 42 of illustrated system 40 is shown in vertical cross-section and is seen to include a housing 60 within which there is mounted a perforated plate 62 having a plurality of openings 64. A catalyst assembly 66 is supported in the housing above the perforated plate 62 and extends upwardly to a distribution plate 68. Fuel is fed to the housing 60 through a fuel line 70 and enters chamber 72 within housing 60 at an inlet 74. The fuel and the catalyst are chosen from among those substances which will cause the fuel to react upon passing through the catalyst assembly 66 and generate a large volume of decomposition gases at very high temperature. The decomposition gases will pass downwardly through the openings 64 in perforated plate 62 and then through an orifice 76 and into manifold 32. The preferred fuel is hydrogen peroxide ($H_2O_2$) which will be decomposed by a suitable catalyst, such as silver, to generate large volumes of high temperature steam and oxygen. Other fuels are available which will be decomposed by a catalyst to form high temperature decomposition gases in large volumes. Thus, other fuels which contain oxidizers and combustibles are available and may be used in monopropellant or bipropellant forms. The technology of devices constructed to operate in the above-described manner is well-developed and has been used extensively in the field of reaction motors. Such technology is discussed in "HYDROGEN PEROXIDE ROCKET MANUAL" by James C. McCormich, FMC Corporation, Buffalo, N.Y., 1970.

The large volumes of high temperature gases made available by gas generator 42 at relatively low velocities enables the gas generator to be placed outside the opening 20 of well casing 18 and connected to the well casing by means of manifold 32 and adaptor sleeve 28. The gases exiting from orifice 76 are at a very high temperature, in excess of the thermal ignition temperature of the hydrocarbons in the formation 10. In order to preclude combustion of the hydrocarbons in the well, the gases exiting from orifice 76 are cooled by a water spray from a nozzle 78 placed in manifold 32 and connected to cooling water inlet 46. A source of water is provided at water tank 80 and is pumped to nozzle 78 by a water pump 82 through a control valve 84. The temperature of the decomposition gases is thus controlled to maintain the temperature below the thermal ignition temperature of the hydrocarbons in the formation 10.

A control valve 90 in the fuel line 70 controls the flow of fuel to gas generator 42. Fuel is supplied from a fuel tank 92 by a fuel pump 94 through control valve 90 and a check valve 96 to gas generator 42 at a rate which enables the desired relatively low velocity in the flow of decomposition gases. The amount of fuel is regulated so as to enable the gas generator to fill the well 16 with decomposition gases at high temperature (just below the thermal ignition temperature of the hydrocarbons in the formation) at an elevated pressure. The low velocity enables laminar flow of the decomposition gases at rates which minimize condensation of the gases and any loss of pressure due to frictional effects as the gases pass into the borehole, so as to maintain the desired high pressure and high temperature. When the appropriate temperature and pressure are reached within the well formation, the sealing valve 34 can be closed to seal the well 16 and enable the high pressure, high temperature gases to fracture the formation 10. A pressure sensor 100 and a temperature sensor 102 are placed in the adaptor sleeve 28 to monitor pressure and temperature in the well 16. Gas generator 42 may be operated periodically in order to maintain the appropriate high pressure and high temperature within the well for a sufficient length of time to attain fracturing. In addition, gas generator 42 may be operated in a pulsed mode to enhance fracturing.

It has been found to be more economical and quite effective to employ a source of compressed gas in combination with the gas generator 42 in system 40 to provide the high pressures required to pack the high temperature gases into the well formation for effective fracturing of formation 10 of well 16 without excessive operation of gas generator 42. In addition, high pressures are more readily attainable through the use of a compressed gas supply system since current designs for gas generators of the type described herein have upper limits in the pressure which can be generated economically. Thus, compressed air supply system 52 includes an engine-driven air compressor 110 which establishes a supply of air under pressure in a storage tank 112. A regulator and filter unit 114 feeds air to an air line 116 connected to air inlet 50 through a check valve 118 and a control valve 120. The compressed air supplied through air line 116 thus can be used in relatively small volumes to pack the high temperature gases supplied by the gas generator 42 under high pressure in the well 16 and to maintain high pressures within the well 16, while the gas generator 42 serves as a supply of a large volume of gases at high temperature to fill the well 16 and raise the pressure in the well to an elevated pressure somewhat below the ultimate desired packed pressure.

In addition to providing for pressurization of the well 16 subsequent to operation of the gas generator 42, compressed air supply system 52 is used advantageously to elevate the pressure in well 16 to an initial pressure prior to operation of the gas generator 42. In this manner, gas generator 42 can be utilized most efficiently to bring the pressure in the well 16 from the initial elevated pressure up to an intermediate elevated pressure, thus taking advantage of the operating characteristics of the gas generator 42, while the compressed air supply system 52 can best be utilized to further elevate the pressure in the well, and to maintain that further elevated pressure until fracturing takes place, as well as to raise the pressure to the initial elevated pressure. The elevation of the pressure within the well 16 to an initial pressure by compressed air supply system 52, rather than by gas generator 42, also serves as an economical test procedure to determine if well 16 is adequately sealed to hold an elevated pressure for effective fracturing of the formation. It would be wasteful to operate gas generator 42 in an attempt to pressurize a well which is not amenable to pressurization.

The following is a description of the operation of system 40 installed in connection with a test well. The test well had an empirically determined volume of 812 cubic feet, of which 300 cubic feet was the measured volume of the well casing and 512 cubic feet was attributed to the effective volume of the formation which was to be fractured. Compressed air was supplied to the well, by means of compressed air supply system 52, until the pressure in the borehole, and the well, was elevated to an initial pressure of 150 psia. The time required to reach that initial pressure was about eight minutes.

Gas generator 42 was then operated for the length of time necessary to consume 100 gallons of fuel. The fuel was hydrogen peroxide ($H_2O_2$) and the time was about thirty-eight to forty minutes. The decomposition gases were cooled with water supplied to nozzle 78 by cooling water supply system 48 so that the temperature of the gases injected into the well was maintained at about 800° F. to 1000° F. and the low velocity of the gases was about two feet per second. In this manner, the pressure in the well was elevated from the initial pressure of 150 psia to an intermediate pressure of about 640 psia.

The compressed air supply system 52 was then operated once again to elevate the pressure in the well to about 740 psia. Fluctuations in the pressure in the well over a period of about three to four hours of supplying compressed air to the well were observed. Thus, the pressure would rise to about 740 psia, then drop to about 620 psia, then rise again to about 720 psia and then drop back to 620 psia. These repeated drops in pressure indicated fracturing of the formation. After about three to four hours the well was sealed, by closing the sealing valve 34 and the air supply control valve 120, and the well remained undisturbed for several hours.

Prior to the above-outlined procedure, the test well was delivering about 1000 cubic feet of gas per day and about one barrel of oil per week. Subsequent to the above-outlined procedure, the well delivered 100,000 cubic feet of gas per day and fifteen barrels of oil per day.

It is pointed out that the decomposition gases supplied by gas generator 42 are steam and oxygen. Additional steam is generated by the cooling water injected at nozzle 78. The steam is at a very high temperature and tends to remain at a high temperature, without excessive condensation, as a result of the elevated pressures in the well and the low delivery velocity. Thus, the elevated pressures serve to maintain the high temperature for a longer period of time while also supplying a driving force to achieve fracturing of the formation. The presence of oxygen provides the added benefit of sterilizing the well by oxidation. The presence of steam and oxygen poses no problem of contamination or disposal. The amount of water remaining after the steam is condensed is very little in comparison to the amounts of water required in other formation fracturing processes. The benign nature of the decomposition gases and the ease with which the gases are generated quickly in the quantities required and then disposed of enables the process to be used repeatedly, if necessary, without excessive logistical problems, without contamination of the well or the well environment, and without the requirement for any period of non-productive clean-up pumping of the well to expell fracturing materials or by-products.

The nature of the supplies and the equipment necessary to install and operate system 40 in the field simplifies transportation and site requirements and renders the method and apparatus exceptionally economical. The ease with which the system is installed and utilized enables the system to be operated by workers having only limited skills.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. The method for increasing the yield of hydrocarbons from an underground hydrocarbon bearing well formation by fracturing the formation, the formation being penetrated by a borehole having an opening at ground level, the method comprising of steps of:

a. placing and connecting a gas generator in position outside the well for supplying heated gas under pressure to the opening of the borehole;

b. essentially sealing the connection between the gas generator and the borehole opening so as to enable the establishment of elevated pressures within the well;

c. operating the gas generator to inject gas into the well at a relatively high temperature, said high temperature being less than the thermal ignition temperature of the hydrocarbons in the formation;

d. increasing the pressure within the well to an elevated relatively high pressure by;

(1) discontinuing operation of the gas generator upon reaching an intermediate pressure;

(2) subsequently raising the pressure within the well to a further elevated pressure above the intermediate pressure; and e. maintaining an elevated pressure in the well at least until the formation is fractured.

2. The invention of claim 1 wherein the step of increasing the pressure within the well includes:

raising the pressure within the well to an initial elevated pressure prior to operation of the gas generator; and subsequently operating the gas generator to increase the pressure within the well to an intermediate pressure above the initial elevated pressure.

3. The invention of claim 1 or 2 wherein the step of maintaining an elevated pressure in the well included maintaining the pressure in the well in the vicinity of the further elevated pressure.

4. The method for increasing the yield of hydrocarbons from an underground hydrocarbon bearing well formation by fracturing the formation, the formation being penetrated by a borehole having an opening at ground level, the method comprising of steps of:

a. placing and connecting a gas generator in position outside the well for supplying heated gas under pressure to the opening of the borehole;

b. essentially sealing the connection between the gas generator and the borehole opening so as to enable the establishment of elevated pressures within the well;

c. operating the gas generator to inject gas into the well at a relatively high temperature, said high temperature being less than the thermal ignition temperature of the hydrocarbons in the formation;

d. increasing the pressure within the well to an elevated relatively high pressure by;

(1) discontinuing operation of the gas generator upon reaching an intermediate pressure;

(2) injecting compressed gas, such as air, into the well to raise the pressure within the well to an initial elevated pressure prior to operation of the gas generator; and e. maintaining an elevated pressure in the well at least until the formation is fractured.

5. The invention of claim 4 wherein the step d. of increasing the pressure within the well further includes:

(3) injecting compressed gas, such as air, into the well to raise the pressure within the well to an initial elevated pressure prior to operation of the gas generator;

(4) subsequently operating the gas generator to increase the pressure within the well to an intermediate pressure above the initial elevated pressure.

6. The invention of claim 5 or 4 wherein the step of maintaining an elevated pressure in the well includes injection compressed gas, such as air, into the well in response to a drop in pressure below the further elevated pressure to maintain the pressure in the well in the vicinity of the further elevated pressure.

7. The invention of claim 1 or 4 wherein the heated gas includes steam.

8. The invention of claim 7 wherein the heated gas includes oxygen.

9. The invention of claim 1, 2, 5, 7, or 4 wherein the gas generator is operated to inject gas into the well at a relatively low velocity.

10. The invention of claim 1, 2, 5, 7 or 4 wherein the gas generator is operated to decompose fuel with a catalyst to form decomposition gases at a temperature above said relatively high temperature and the decomposition gases are cooled to obtain the relatively high temperature gas injected into the well.

11. The invention of claim 10 wherein the decomposition gases are cooled with water.

12. The invention of claim 11 wherein the gas generator is operated to inject gas into the well at a relatively low velocity.

13. The invention of claim 10 wherein the gas generator is operated to inject gas into the well at a relatively low velocity.

14. Apparatus for increasing the yield of hydrocarbons from an underground by hydrocarbon bearing well formation by fracturing the formation, the formation being penetrated by a borehole having an opening at ground level, said apparatus comprising:

a gas generator for operation to inject gas, in which generator a fuel is decomposed by a catalyst to form high temperature decomposition gases, which are injected under pressure into the well at a relatively high temperature, said high temperature being less than the thermal ignition temperature of the hydrocarbons in the formation;

means for placing and connecting the gas generator in position outside the well for supplying said high temperature gas under pressure to the opening of the borehole;

means for essentially sealing the connection between the gas generator and the borehole opening so as to enable the establishment and maintenance of elevated pressures within the well at least until the formation is fractured; and, wherein the high temperature of the decomposition gases exceeds the thermal ignition temperature of the hydrocarbons in the formation and the gas generator includes means for cooling the decomposition gases such that the high temperature of the gas injected under pressure into the well is less than the thermal ignition temperature of the hydrocarbons in the formation.

15. The invention of claim 14 including supplemental means for increasing the pressure within the well independent of the gas generator and for maintaining said increased pressure.

16. The invention of claim 15 wherein the supplemental means includes means for injecting compressed gas, such as air, into the well to raise the pressure within the well independent of the operation of the gas generator.

17. The invention of claim 15 wherein the supplemental means includes means for injecting compressed gas, such as air, into the well in response to a drop in pressure below a predetermined elevated pressure to maintain the pressure in the well in the vicinity of the predetermined elevated pressure, independent of the operation of the gas generator at least until the formation is fractured.

18. The invention of claim 15, 16 or 17 wherein the supplemental means includes a motor-driven gas compressor connected to the opening of the borehole.

19. The invention of claim 14 wherein the means for cooling the decomposition gases includes a cooling water supply means for spraying cooling water into the decomposition gases.

20. The invention of claim 19 wherein the fuel is hydrogen peroxide and the high temperature decomposition gases include steam.

21. The invention of claim 20 wherein the decomposition gases include oxygen.

22. The invention of claim 14 wherein the gas generator is of the type in which the gas injected into the well is delivered at a relatively low velocity.

23. The invention of claim 22 including means for regulating the flow of fuel to the gas generator so as to attain the relatively low velocity.

* * * * *